US009918577B1

(12) United States Patent
Brown

(10) Patent No.: US 9,918,577 B1
(45) Date of Patent: Mar. 20, 2018

(54) MAIL NOTIFICATION SYSTEM

(71) Applicant: Stanley Brown, Ruskin, FL (US)

(72) Inventor: Stanley Brown, Ruskin, FL (US)

( * ) Notice: Subject to any disclaimer, the term of this patent is extended or adjusted under 35 U.S.C. 154(b) by 0 days.

(21) Appl. No.: 15/608,639

(22) Filed: May 30, 2017

(51) Int. Cl.
*G08B 13/14* (2006.01)
*A47G 29/122* (2006.01)
*G08B 5/36* (2006.01)

(52) U.S. Cl.
CPC ..... *A47G 29/1225* (2013.01); *G08B 5/36* (2013.01); *A47G 2029/1226* (2013.01)

(58) Field of Classification Search
CPC ..... H04L 1/00; H04W 4/00
See application file for complete search history.

(56) References Cited

U.S. PATENT DOCUMENTS 3,611,333 A 10/1971 Conigliaro
5,023,595 A 6/1991 Bennett
5,440,294 A 8/1995 Mercier et al.
6,275,154 B1 * 8/2001 Bennett ..... A47G 29/1214 340/569
6,694,580 B1 2/2004 Hatzold
6,831,558 B1 12/2004 Andrew
D518,399 S 4/2006 Breslow
7,187,285 B2 * 3/2007 Staples ..... A47G 29/1214 200/61.63
7,506,796 B1 3/2009 Hanna
7,786,862 B1 8/2010 Campbell
2004/0060975 A1 4/2004 Dalgaard et al.
2012/0046890 A1 * 2/2012 Pennington ..... G01D 4/002 702/61
2013/0003417 A1 * 1/2013 Chien ..... F21S 8/035 362/646
2014/0320663 A1 * 10/2014 Chien ..... H04N 5/2354 348/159

* cited by examiner

*Primary Examiner* — Shirley Lu

(57) ABSTRACT

A mail notification system includes an alert unit that is positioned in a mailbox thereby facilitating the alert unit to sense when mail is placed in the mailbox. The alert unit transmits a first alert signal when the mail is placed in the mailbox. A display unit is provided and the display unit is in electrical communication with the alert unit. The display unit transmits a second alert signal when the display unit receives the first alert signal. An electronic device is provided and the electronic device is in wireless electrical communication with the display unit. The electronic device generates an alert when the display unit transmits the second alert signal. In this way the electronic device notifies the user of the mail in the mailbox.

10 Claims, 3 Drawing Sheets

MAIL NOTIFICATION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to notification devices and more particularly pertains to a new notification device for notifying a user that mail has been deposited in a mailbox.

BRIEF SUMMARY OF THE INVENTION

An embodiment of the disclosure meets the needs presented above by generally comprising an alert unit that is positioned in a mailbox thereby facilitating the alert unit to sense when mail is placed in the mailbox. The alert unit transmits a first alert signal when the mail is placed in the mailbox. A display unit is provided and the display unit is in electrical communication with the alert unit. The display unit transmits a second alert signal when the display unit receives the first alert signal. An electronic device is provided and the electronic device is in wireless electrical communication with the display unit. The electronic device generates an alert when the display unit transmits the second alert signal. In this way the electronic device notifies the user of the mail in the mailbox.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
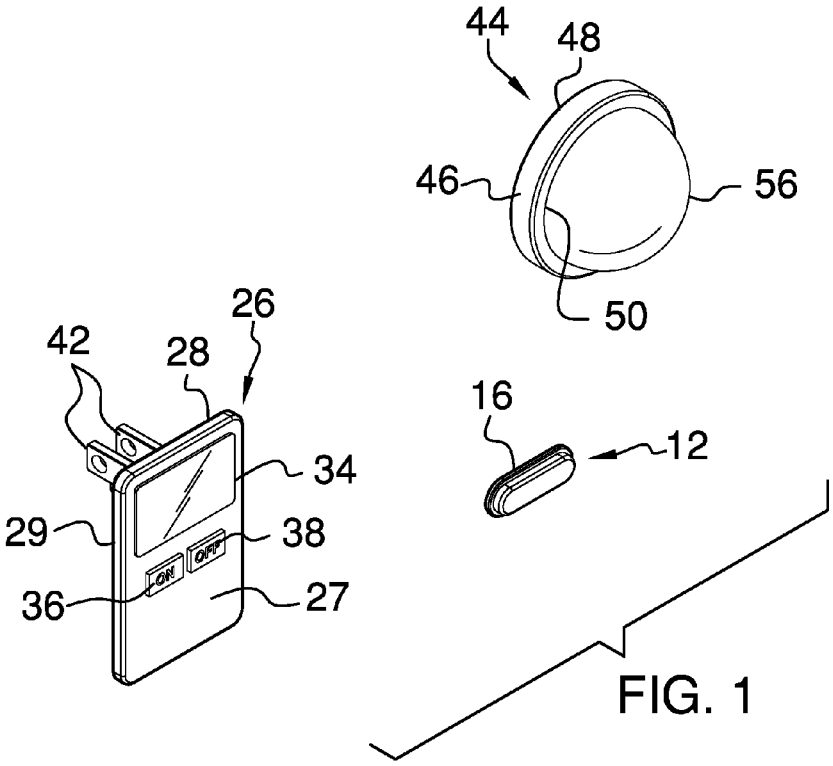
FIG. 1 is a perspective view of a mail notification system according to an embodiment of the disclosure.
Figure 2:
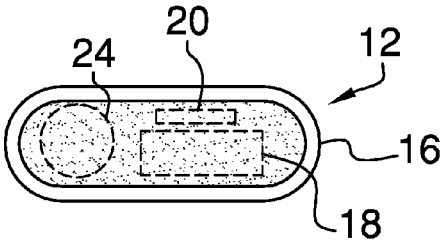
FIG. 2 is a back phantom view an alert unit of an embodiment of the disclosure.
Figure 3:
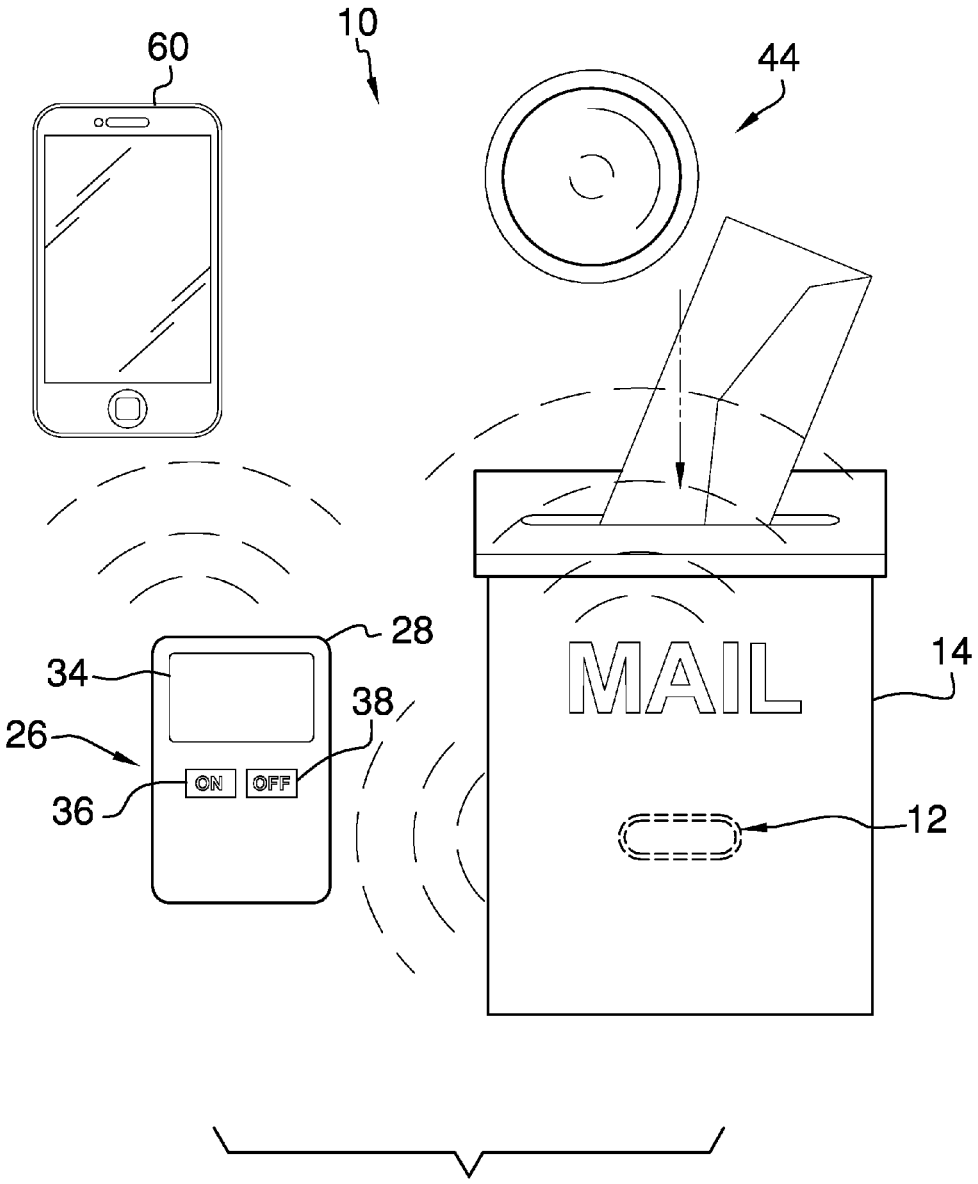
FIG. 3 is a front perspective view of an embodiment of the disclosure.
Figure 4:
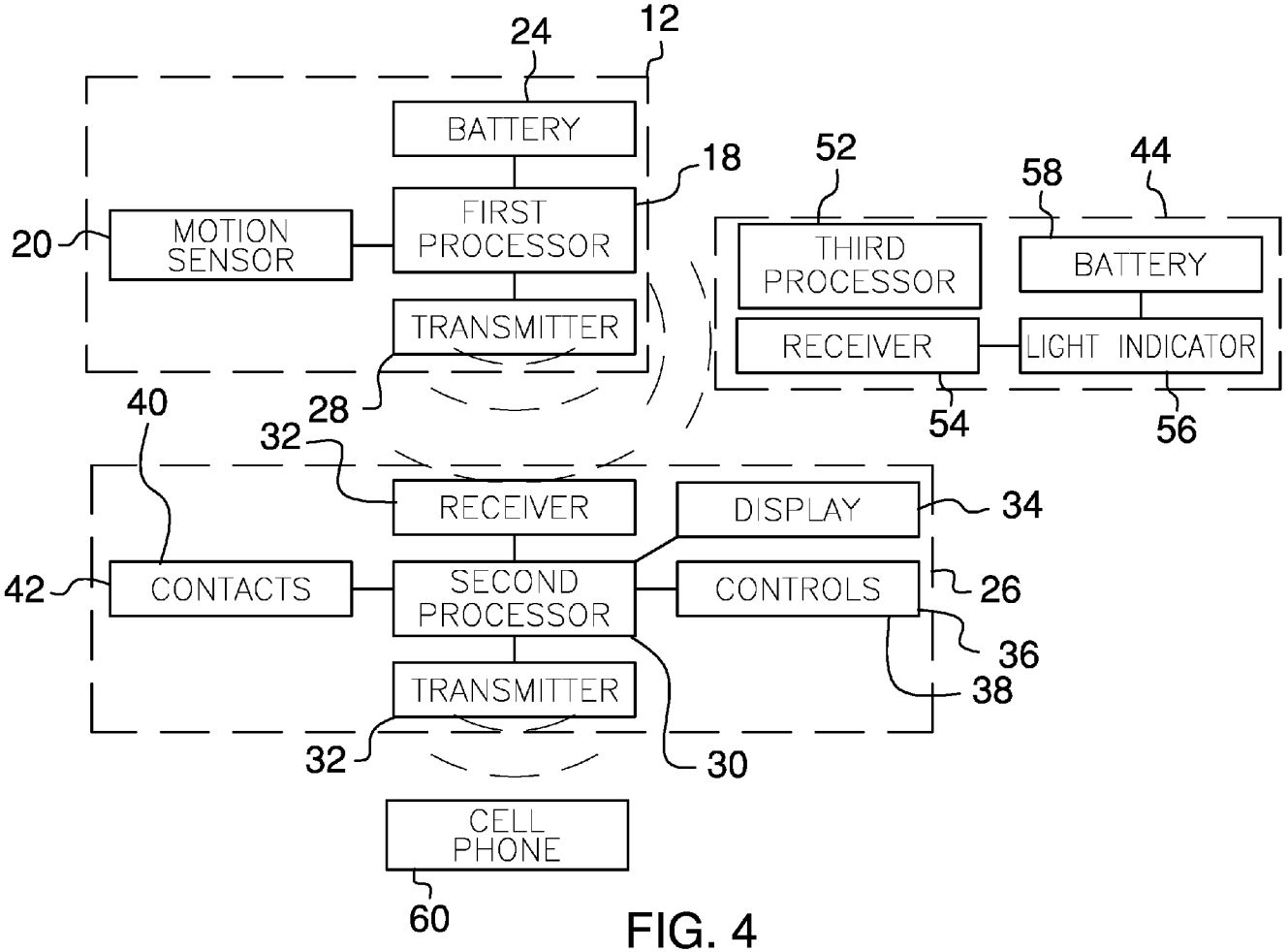
FIG. 4 is a schematic view of an embodiment of the disclosure.

With reference now to the drawings, and in particular to FIGS. 1 through 4 thereof, a new notification device embodying the principles and concepts of an embodiment of the disclosure and generally designated by the reference numeral 10 will be described.

As best illustrated in FIGS. 1 through 4, the mail notification system 10 generally comprises an alert unit 12 that is positioned in a mailbox 14 thereby facilitating the alert unit 12 to sense when mail is placed in the mailbox 14. The mailbox 14 may be a mailbox 14 that conforms to USPS regulations and requirements. The mail may be mail delivered by the USPS. The alert unit 12 transmits a first alert signal when the mail is placed in the mailbox 14.

The alert unit 12 comprises a first housing 16 that is positioned in the mailbox 14. A first processor 18 is positioned within the first housing 16 and the first processor 18 selectively generates a first alert sequence. A motion detector 20 is coupled to the first housing 16 and the motion detector 20 detects motion. The motion detector 20 is electrically coupled to the first processor 18. Moreover, the first processor 18 generates the first alert sequence when the motion detector 20 detects mail is inserted into the mailbox 14. The motion detector 20 may be an electronic motion detector 20 or the like.

A transmitter 22 is positioned within the first housing 16 and the transmitter 22 is electrically coupled to the first processor 18. The transmitter 22 transmits the first alert signal when the first processor 18 generates the alert sequence. The transmitter 22 may be a radio frequency transmitter 22 or the like and the transmitter 22 may employ a WPAN signal. A first power supply 24 is positioned within the first housing 16 and the first power supply 24 is electrically coupled to the first processor 18. The first power supply 24 comprises at least one battery.

A display unit 26 is positioned in a building or the like such that the display unit 26 is visible to a user. The display unit 26 is in electrical communication with the alert unit 12. The display unit 26 transmits a second alert signal when the display unit 26 receives the first alert signal. Additionally, the display unit 26 emits a visual alert when the alert unit 12 transmits the first alert signal. In this way the display unit 26 notifies the user that mail is in the mailbox 14.

The display unit 26 comprises a second housing 28 that has a front side 27 and a back side 29. A second processor 30 is positioned within the second housing 28 and the second processor 30 selectively generates a second alert sequence. A transceiver 32 is positioned within the second housing 28 and the transceiver 32 is electrically coupled to the second processor 30. The transceiver 32 is in electrical communication with the transmitter 22 such that the transceiver 32 receives the first alert signal. The second processor 30 generates the second alert sequence when the transceiver 32 receives the first alert signal. Moreover, the transceiver 32 transmits the second alert signal when the second processor 30 generates the second alert sequence. The transceiver 32 may be a radio frequency transceiver 32 or the like and the transceiver 32 may employ a WPAN signal.

A display 34 is coupled to the front side 27 of the housing such that the display 34 is visible to the user. The display 34 is electrically coupled to the second processor 30 and the display 34 displays indicia. The indicia comprise operational parameters of the second processor 30. The display 34 may comprise an LED or the like.

An on button 36 is coupled to the front side 27 of the second housing 28 and the on button 36 is electrically coupled to the second processor 30. The on button 36 turns the second processor 30 on when the on button 36 is manipulated. An off button 38 is coupled to the front side 27 of the second housing 28 and the off button 38 is electrically coupled to the second processor 30. The off button 38 turns the second processor 30 off when the off button 38 is manipulated.

A second power supply 40 is coupled to the second housing 28 and the second power supply 40 is electrically coupled to the second processor 30. The second power supply 40 comprises a pair of contacts 42 each extending away from the back side 29 of the second housing 28. Each of the contacts 42 is selectively inserted into a female electrical outlet.

A light unit 44 is provided and the light unit 44 is coupled to a support surface thereby facilitating the light unit 44 to be visible. The light unit 44 is turned on when the alert unit 12 transmits the first alert signal. In this way the light unit 44 alerts the user that the mail has been placed in the mailbox 14. The light unit 44 comprises a third housing 46 that has a first side 48 and a second side 50. The first side 48 is coupled to a support surface such as a wall or the like.

A third processor 52 is positioned within the third housing 46 and the third processor 52 selectively generates a third alert sequence. A receiver 54 is positioned within the third housing 46 and the receiver 54 is electrically coupled to the third processor 52. The receiver 54 is in electrical communication with the transceiver 32. Moreover, the third processor 52 generates the third alert sequence when the receiver 54 receives the second alert signal from the transceiver 32. The receiver 54 may be a radio frequency receiver 54 or the like and the receiver 54 may employ a WPAN signal.

A light emitter 56 is coupled to the second side 50 of the third housing 46 to selectively emit light outwardly therefrom. The light emitter 56 is electrically coupled to the third processor 52 and the light emitter 56 is turned on when the third processor 52 generates the third alert sequence wherein the light emitter 56. The light emitter 56 may be an LED or the like and a dome shaped lens may be positioned over the light emitter 56. A third power supply 58 is positioned within the third housing 46 and the third power supply 58 is electrically coupled to the third processor 52. The third power supply 58 comprises at least one battery.

An electronic device 60 is provided and the electronic device 60 is manipulated by the user. The electronic device 60 is in wireless electrical communication with the display unit 26. Additionally, the electronic device 60 generates an alert when the display unit 26 transmits the second alert signal. In this way the electronic device 60 notifies the user of the mail in the mailbox 14. The electronic device 60 may be a smart phone or the like and the alert may be a visual alert, an audio alert and a haptic alert.

In use, the motion detector 20 detects the motion associated with the mail being inserted into the mailbox 14. The transmitter 22 transmits the first alert signal when the motion detector 20 detects the motion. The transceiver 32 receives the first alert signal and the transceiver 32 subsequently transmits the second alert signal. The receiver 54 receives the second alert signal and the light emitter 56 is subsequently turned on to visually alert the user that the mail is in the mailbox 14. Additionally, the electronic device 60 receives the second alert signal and the electronic device 60 subsequently generates the alert. In this way the user is notified when the mail is in the mailbox 14 thereby inhibiting the user from making a needless trip to check an empty mailbox 14.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mail notification system being configured to generate an alert when mail is deposited in a mailbox, said system comprising:

an alert unit configured to be positioned in a mailbox thereby facilitating said alert unit to sense when mail is placed in the mailbox, said alert unit transmitting a first alert signal when the mail is placed in the mailbox, said alert unit comprising a first housing being configured to be positioned in the mailbox, and a first processor being positioned within said first housing, said first processor selectively generating a first alert sequence;

a display unit being configured to be positioned to be visible to a user, said display unit being in electrical communication with said alert unit, said display unit transmitting a second alert signal when said display unit receives said first alert signal, said display unit comprising a second housing having a front side and a back side, and a second processor being positioned within said second housing, said second processor selectively generating a second alert sequence;

a light unit being configured to be coupled to a support surface thereby facilitating said light unit to be visible, said light unit being turned on when said alert unit transmits said first alert signal wherein said light unit is configured to alert the user that the mail has been placed in the mailbox, said light unit comprising a third housing having a first side and a second side, said first side being configured to be coupled to a support surface, and a third processor being positioned within said third housing, said third processor selectively generating a third alert sequence;

a transceiver selectively transmitting said second alert signal;

a receiver being positioned within said third housing, said receiver being electrically coupled to said third processor, said receiver being in electrical communication with said transceiver, said third processor generating said third alert sequence when said receiver receives said second alert signal from said transceiver; and an electronic device being configured to be manipulated, said electronic device being in wireless electrical communication with said display unit, said electronic device generating an alert when said display unit transmits said second alert signal wherein said electronic device is configured to notify the user of the mail in the mailbox.

2. The system according to claim 1, further comprising a motion detector being coupled to said first housing wherein said motion detector is configured to detect motion, said motion detector being electrically coupled to said first processor, said first processor generating said first alert sequence when said motion detector detects mail being inserted into the mailbox.

3. The system according to claim 1, further comprising a transmitter being positioned within said first housing, said transmitter being electrically coupled to said first processor, said transmitter transmitting said first alert signal when said first processor generates said alert sequence.

4. The system according to claim 1, further comprising a first power supply being positioned within said first housing, said first power supply being electrically coupled to said first processor, said first power supply comprising at least one battery.

5. The system according to claim 1, further comprising:

a transmitter selectively transmitting said first alert signal; and a transceiver being positioned within said second housing, said transceiver being electrically coupled to said second processor, said transceiver being in electrical communication with said transmitter such that said transceiver receives said first alert signal, said second processor generating said second alert sequence when said transceiver receives said first alert signal, said transceiver transmitting the second alert signal when said second processor generates said second alert sequence.

6. The system according to claim 1, further comprising a display being coupled to said front side of said housing wherein said display is configured to be visible to the user, said display being electrically coupled to said second processor, said display displaying indicia, said indicia comprising operational parameters of said second processor.

7. The system according to claim 1, further comprising:

an on button being coupled to said front side of said second housing, said on button being electrically coupled to said second processor, said on button turning said second processor on when said on button is manipulated; and an off button being coupled to said front side of said second housing, said off button being electrically coupled to said second processor, said off button turning said second processor off when said off button is manipulated.

8. The system according to claim 1, further comprising a light emitter being coupled to said second side of said third housing wherein said light emitter is configured to selectively emit light outwardly therefrom, said light emitter being electrically coupled to said third processor, said light emitter being turned on when said third processor generates said third alert sequence wherein said light.

9. The system according to claim 1, further comprising a third power supply being positioned within said third housing, said third power supply being electrically coupled to said third processor, said third power supply comprising at least one battery.

10. A mail notification system being configured to generate an alert when mail is deposited in a mailbox, said system comprising:

an alert unit configured to be positioned in a mailbox thereby facilitating said alert unit to sense when mail is placed in the mailbox, said alert unit transmitting a first alert signal when the mail is placed in the mailbox, said alert unit comprising:

a first housing being configured to be positioned in the mailbox, a first processor being positioned within said first housing, said first processor selectively generating a first alert sequence, a motion detector being coupled to said first housing wherein said motion detector is configured to detect motion, said motion detector being electrically coupled to said first processor, said first processor generating said first alert sequence when said motion detector detects mail being inserted into the mailbox, a transmitter being positioned within said first housing, said transmitter being electrically coupled to said first processor, said transmitter transmitting said first alert signal when said first processor generates said alert sequence, and a first power supply being positioned within said first housing, said first power supply being electrically coupled to said first processor, said first power supply comprising at least one battery;

a display unit being configured to be positioned to be visible to a user, said display unit being in electrical communication with said alert unit, said display unit transmitting a second alert signal when said display unit receives said first alert signal, said display unit comprising:

a second housing having a front side and a back side, a second processor being positioned within said second housing, said second processor selectively generating a second alert sequence, a transceiver being positioned within said second housing, said transceiver being electrically coupled to said second processor, said transceiver being in electrical communication with said transmitter such that said transceiver receives said first alert signal, said second processor generating said second alert sequence when said transceiver receives said first alert signal, said transceiver transmitting the second alert signal when said second processor generates said second alert sequence, a display being coupled to said front side of said housing wherein said display is configured to be visible to the user, said display being electrically coupled to said second processor, said display displaying indicia, said indicia comprising operational parameters of said second processor, an on button being coupled to said front side of said second housing, said on button being electrically coupled to said second processor, said on button turning said second processor on when said on button is manipulated, an off button being coupled to said front side of said second housing, said off button being electrically coupled to said second processor, said off button turning said second processor off when said off button is manipulated, and a second power supply being coupled to said second housing, said second power supply being electrically coupled to said second processor, said second power supply comprising a pair of contacts each extending away from said back side of said second housing, each of said contacts being configured to be inserted into a female electrical outlet, a light unit being configured to be coupled to a support surface thereby facilitating said light unit to be visible, said light unit being turned on when said alert unit transmits said first alert signal wherein said light unit is configured to alert the user that the mail has been placed in the mailbox, said light unit comprising:

a third housing having a first side and a second side, said first side being configured to be coupled to a support surface, a third processor being positioned within said third housing, said third processor selectively generating a third alert sequence, a receiver being positioned within said third housing, said receiver being electrically coupled to said third processor, said receiver being in electrical communication with said transceiver, said third processor generating said third alert sequence when said receiver receives said second alert signal from said transceiver, a light emitter being coupled to said second side of said third housing wherein said light emitter is configured to selectively emit light outwardly therefrom, said light emitter being electrically coupled to said third processor, said light emitter being turned on when said third processor generates said third alert sequence wherein said light emitter, and a third power supply being positioned within said third housing, said third power supply being electrically coupled to said third processor, said third power supply comprising at least one battery; and an electronic device being configured to be manipulated, said electronic device being in wireless electrical communication with said display unit, said electronic device generating an alert when said display unit transmits said second alert signal wherein said electronic device is configured to notify the user of the mail in the mailbox.

* * * * *